US007905819B2

(12) United States Patent
Alessandri et al.

(10) Patent No.: US 7,905,819 B2
(45) Date of Patent: Mar. 15, 2011

(54) FORCE MODULATING DEVICE FOR A GYM MACHINE

(75) Inventors: Nerio Alessandri, Longiano (IT); Leo Zaccherini, Riolo Terme (IT)

(73) Assignee: Technogym S.p.A., Gambettola (IT)

( * ) Notice: Subject to any disclaimer, the term of this patent is extended or adjusted under 35 U.S.C. 154(b) by 21 days.

(21) Appl. No.: 12/427,115

(22) Filed: Apr. 21, 2009

(65) Prior Publication Data

US 2009/0270234 A1 Oct. 29, 2009

(30) Foreign Application Priority Data

Apr. 28, 2008 (IT) ..... BO2008A0267

(51) Int. Cl.
*A63B 21/062* (2006.01)
*A63B 21/00* (2006.01)

(52) U.S. Cl. ..... 482/99; 482/133

(58) Field of Classification Search ..... 482/5, 92, 482/99–103, 129–130, 142, 133–135
See application file for complete search history.

(56) References Cited

U.S. PATENT DOCUMENTS

| | | | | |
|---|---|---|---|---|
| 1,837,531 | A | 12/1931 | Cole | |
| 4,989,861 | A * | 2/1991 | Halpern | 482/5 |
| 7,214,170 | B2 * | 5/2007 | Sumners et al. | 482/92 |
| 7,238,143 | B1 | 7/2007 | Sokolovos | |
| 2006/0019805 | A1 | 1/2006 | Heck | |
| 2008/0318732 | A1 * | 12/2008 | Shih | 482/1 |
| 2009/0221402 | A1 * | 9/2009 | Yeh | 482/5 |

* cited by examiner

*Primary Examiner* — Fenn C Mathew
(74) *Attorney, Agent, or Firm* — Pearne & Gordon LLP

(57) ABSTRACT

Described is a device for a gym machine comprising a frame (2), at least one resistant load (3) mounted on the frame having at least one coupling surface (4), at least one flexible cable (5) associated with the resistant load (3) for performing a physical exercise, the device being characterized in that it comprises at least one support (6) designed to be rigidly associated with the resistant load (3) at the coupling surface (4), at least one shaft (7) rotatably coupled to the support (6) on a first axis (8) at a first portion (9) and having a second portion (10) with a second, eccentric axis (11), power drive means (12) for rotationally driving the shaft (7) about the first axis (8), the shaft (7) being associated with the flexible cable (5) at the second portion (10) in such a way as to generate vibrations along the flexible cable (5).

16 Claims, 3 Drawing Sheets

FORCE MODULATING DEVICE FOR A GYM MACHINE

BACKGROUND OF THE INVENTION

This invention addresses a device for a gym machine used to perform a physical exercise. In particular, this invention relates to a resistant force modulating device for a gym machine used for muscle force training. More in detail, this invention relates to a resistant force modulating device for a gym machine used for training muscle force by operating a tool connected to a resistant load which the resistant force is associated with.

Known in prior art are gym machines used for developing muscle force and comprising a frame, a resistant load normally in the form of a weight stack mobile relative to the frame on vertical guides, at least one lever pivoted to the frame and having a handgrip or tool mounted on the end of it. The lever is associated with the resistant load by means of a flexible cable. During the physical exercise for muscle training, the user operates the lever with the handgrip to oppose the resistant load, performing a movement that is guided and constrained by the lever. Alternatively, in other prior art gym machines, the handgrip is connected directly to the resistant load by a flexible cable. In the latter machines, unlike the those of the former kind, the user's training movements are not constrained in space.

The application of vibrations to gym machines for developing muscle force has been known for some time. In particular, gym machines are known where the tool is connected directly to a device for generating vibrations which causes the tool itself to vibrate. These devices consist, for example, of an eccentric weight that is made to rotate by an electric motor.

Devices known up to now have several disadvantages.

First of all, they are complex to make in the presence of constraints such as compact size and light weight, which are not always compatible with the eccentric weight used to generate the vibrations. Further, they are not well integrated in the machine and constitute an external component of the machine. Moreover, they must be mounted on the gym machine every time a training session with vibrations is required. Mounting the vibrating device, besides being a highly time-consuming and tedious task for the trainer or gym user, may be relatively difficult because it involves removing the tool from the lever or from the cable, and then re-fitting it after mounting the vibrating device. In some cases, the task is best done by a specialist who is hardly ever available in a gym or other physical training facility.

The technical purpose of this invention is to overcome the above mentioned disadvantages by providing a device that is at once easy to make, compact in size, light in weight and able to be well integrated in the gym machine.

In the context of this technical purpose, the invention has for an aim to provide a device that can be mounted on the gym machine quickly and easily.

It is a further aim of the invention to provide a device for gym machines that has a simple structure, is practical to set up, safe and effective to use and relatively inexpensive.

SUMMARY OF THE INVENTION

The above mentioned purpose and aims are all achieved by the device according to this invention for a gym machine comprising a frame, at least one resistant load mounted on the frame having at least one coupling surface, and at least one flexible cable associated with the resistant load for performing a physical exercise, the device being characterized in that it comprises at least one support designed to be rigidly associated with the resistant load at the coupling surface, at least one shaft rotatably coupled to the support on a first axis at a first portion and having a second portion with a second eccentric axis, power drive means for rotationally driving the shaft about the first axis, the shaft being associated with the flexible cable at the second portion in such a way as to generate vibrations along the flexible cable.

BRIEF DESCRIPTION OF THE DRAWINGS

The technical characteristics of the invention, with reference to the above aims, are clearly described in the claims below and its advantages are more apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
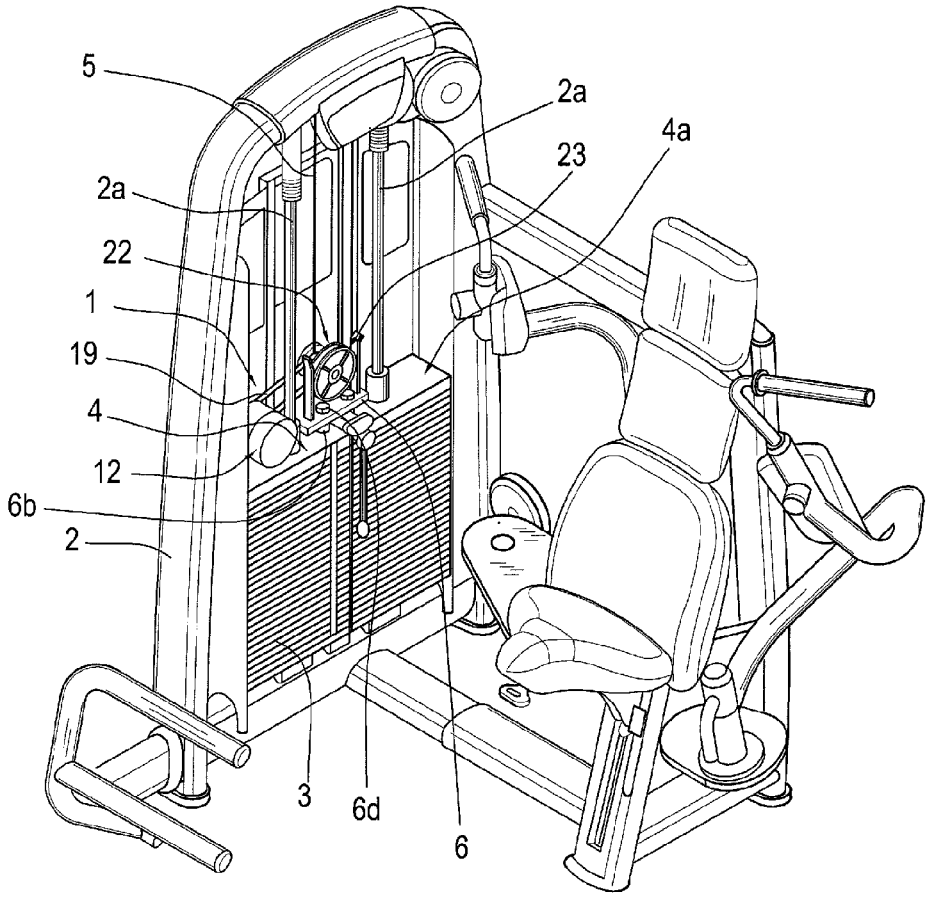
FIG. 1 is a perspective view of a gym machine fitted with a first embodiment of the device according to the invention.
Figure 2:
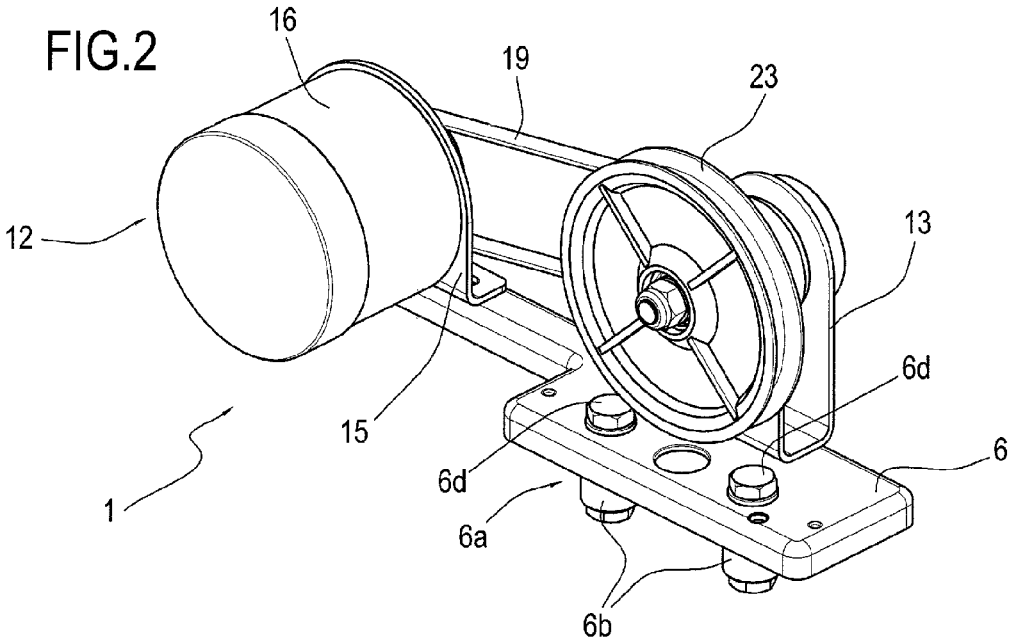
FIG. 2 is a perspective view of the first embodiment of the device according to the invention.
Figure 3:
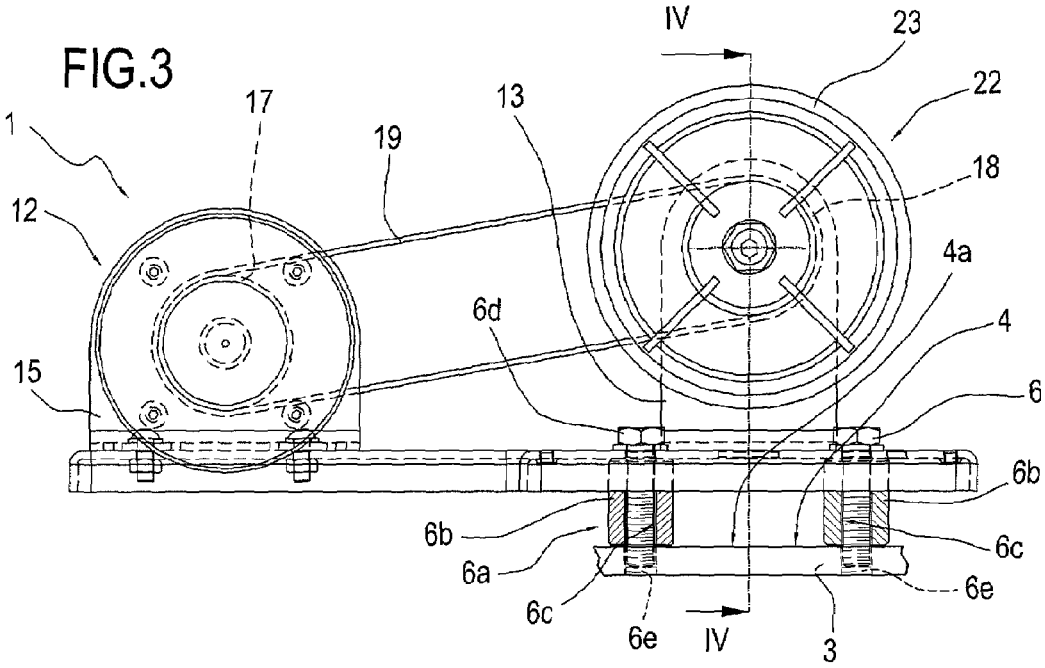
FIG. 3 is a side elevation view of the device of FIG. 2.

With reference to accompanying drawings, and with reference in particular to FIGS. 1 to 4, the numeral 1 denotes a device for a gym machine according to the invention that can be used to perform physical exercises for developing muscle force. In one possible embodiment, shown in FIG. 1, where for simplicity of illustration some parts of the gym machine have been omitted, the device 1 is associated with a gym machine of the type comprising a frame 2 and a resistant load 3 mounted on the frame 2. In this particular case, the resistant load 3 is of the gravity type, in the form of a weight stack, is mounted on the frame 2 slidably on vertical guides 2*a* and has at least one coupling surface 4 at the top surface 4*a* of the first brick of the weight stack. The gym machine also comprises at least one flexible cable 5 connected to the frame 2 by means of pulleys, not shown in FIG. 1, freely rotatably mounted on the frame 2 itself to connect the tool, which the user interacts with during the performance of the physical exercise, to the resistant load 3. In particular, a portion of the cable 5 is connected to at least one lever pivoted to the frame to be operated by a handgrip in gym machines with guided movement, as shown in FIG. 1, or is connected directly to the handgrip in gym machines allowing unconstrained movement in space. Further, the cable 5 is associated with the resistant load 3 at a middle or end portion of it depending on whether there are two levers/handgrips or only one lever/handgrip, respectively, according to the type of gym machine.

The device 1 according to the invention comprises a support 6 rigidly associated with the resistant load 3 at the coupling surface 4. In particular, a portion of the support 6 is plate shaped and is conveniently fastened to the resistant load 3, on the top surface 4*a*, by screw means 6*a*. More in detail, the device preferably comprises two cylindrical spacers 6*b* having respective axial holes 6*c*, shown in FIG. 3, for the passage of respective screws 6*d* designed to be screwed into corresponding threaded holes 6*e*, also schematically represented by dashed lines in FIG. 3, made in the resistant load 3 in order to fasten the support 6.

The device 1 also comprises a shaft 7 rotatably coupled to the support 6 on a first axis 8 at a first portion of it 9. Conveniently, the shaft 7 has a second portion 10 forming a second, eccentric axis 11. The shaft 7 is rotationally driven about the first axis 8 by power drive means 12 and is associated with the flexible cable 5 at the second portion 10.

Figure 4:
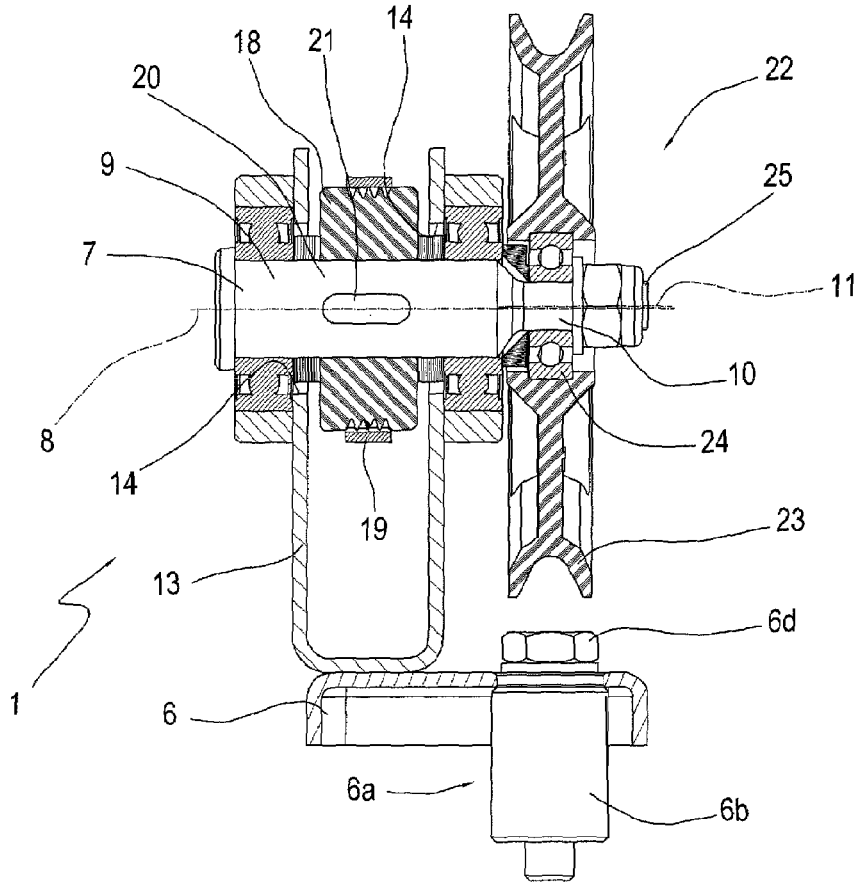
FIG. 4 is a side elevation view of a cross section of the device through the plane IV-IV of FIG. 3.
Figure 6:
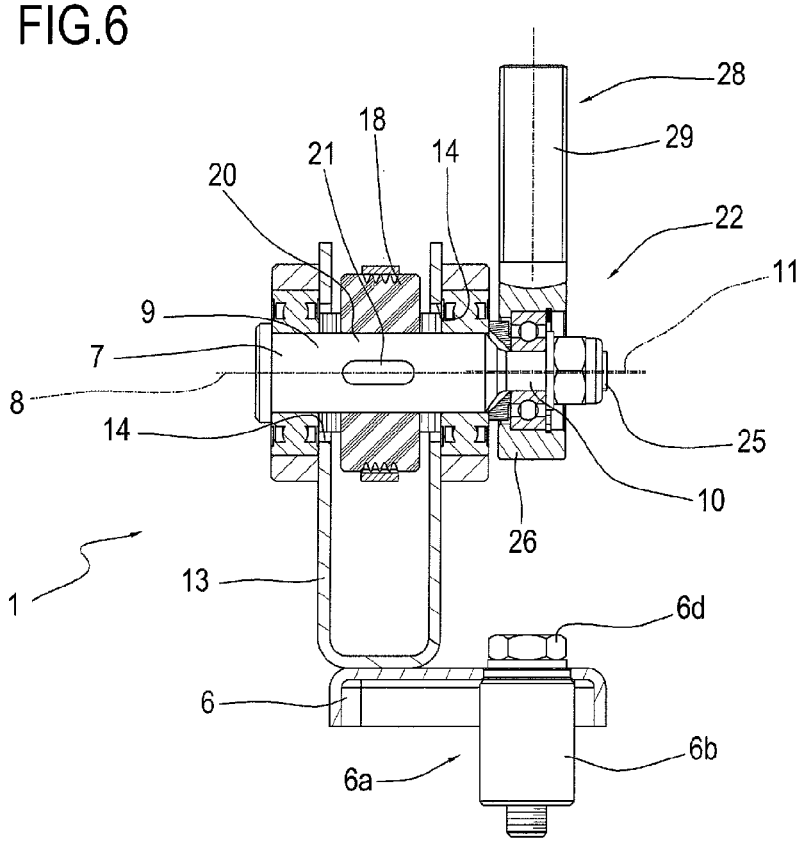
FIG. 6 is a side elevation view of a cross section of the device through the plane VI-VI of FIG. 5.

Advantageously, the support 6 comprises a first bracket 13 to which the first portion 9 of the shaft 7 is rotatably coupled to rotate about the first axis 8. The first bracket 13 is conveniently U-shaped and has at least two coaxial annular grooves 14 for receiving respective ball bearings for coupling to the shaft 7, as illustrated in FIGS. 4 and 6.

Conveniently, the support 6 comprises a second bracket 15 for mounting the power drive means 12. The power drive means 12 comprise a motor 16 for rotationally driving a drive pulley 17 at a predetermined speed of rotation. The device 1 also comprises a driven pulley 18 keyed to the shaft 7. The driven pulley 18 is preferably keyed rigidly to the shaft 7 at a middle portion 20 by means of a key 21. The drive pulley 17 is connected to the driven pulley 18 by a belt 19 so as to transmit rotational drive to the shaft 7.

The device 1 further usefully comprises coupling means 22 freely rotatably associated with the shaft 7, at the second portion 10, on the second eccentric axis 11, in such a way as to connect the shaft 7 to the flexible cable 5.

As illustrated in FIGS. 1 to 4, the coupling means 22 advantageously comprise an idler pulley 23 freely rotatably coupled to the shaft 7, at the second portion 10, on the second eccentric axis 11. The idler pulley 23 has the flexible cable 5 wound around it and it is preferably coupled to the second portion 10 by an interposed first bearing 24. More in detail, the second portion 10 conveniently has a threaded end part 25 for fastening the internal ring of the first bearing 24 to the shaft 7 with a bolt.

Figure 5:
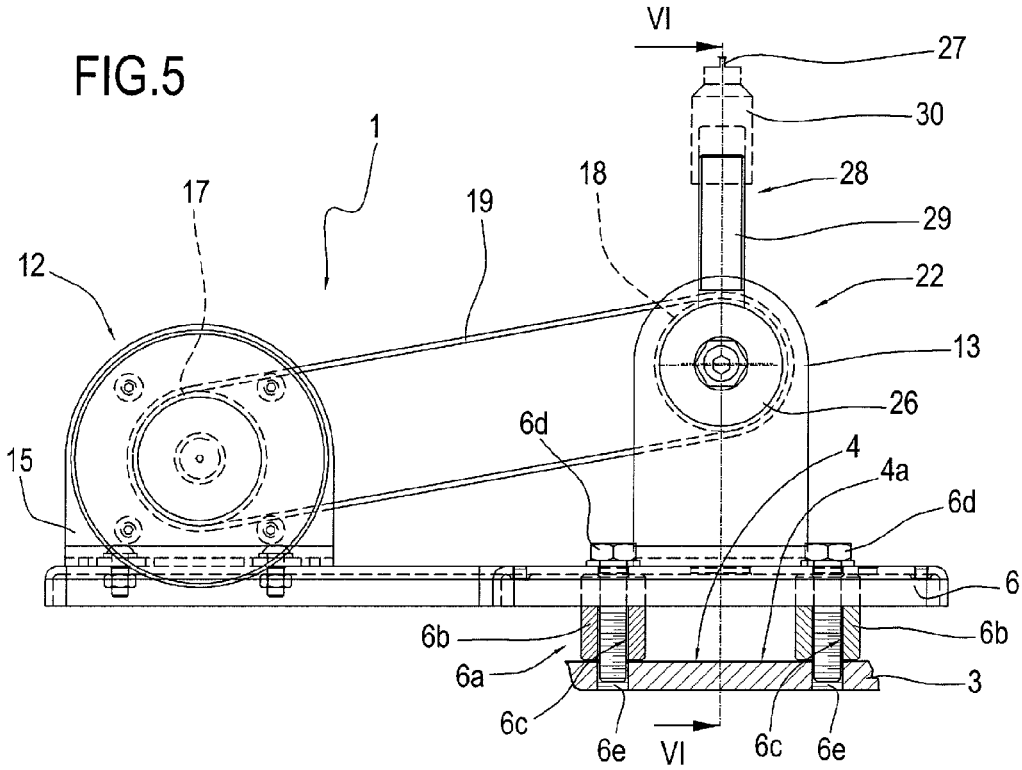
FIG. 5 is a side elevation view of a second embodiment of the device according to the invention.

In a second non-limiting embodiment of the device 1, illustrated in FIGS. 5 and 6, the coupling means 22 comprise a ring 26 coupled freely rotatably to the shaft 7, at the second portion 10, on the second eccentric axis 11. The ring 26 is rigidly associated with one end 27 of the flexible cable 5 at a suitable radial coupling seat 28. Conveniently, the ring 26 comprises a threaded cylindrical extension 29 and the flexible cable is integrally connected at its end 27 to an internally threaded pipe 30, drawn with a dashed line in FIG. 5, designed to be screwed to the ring 26 at the cylindrical extension 29, in such a way as to fix the flexible cable 5 to the ring 26.

The operation of the device 1 according to the invention is intuitive and is described below.

During training, the shaft 7 is rotationally driven about the first axis 8 by the power drive means 12 and is associated with the flexible cable 5 at the second portion 10 in such a way as to generate vibrations along the flexible cable 5.

More in detail, the coupling means 22 associated freely rotatably with the shaft 7 at the second portion 10, on the second eccentric axis 11, connect the shaft 7 to the flexible cable 5 in such a way that the rotation of the shaft 7 about the first axis 8 causes the coupling means 22 to oscillate, thereby creating vibrations along the flexible cable 5.

In particular, with reference to FIGS. 1 to 4, the idler pulley 23 of the coupling means 22 has the flexible cable 5 wound around it to apply an action opposing the resistant load 3 in such a way that the rotation of the shaft 7 about the first axis 8 causes the idler pulley 23 to oscillate, thereby creating vibrations along the flexible cable 5.

In the second embodiment of the device 1, with reference to FIGS. 5 and 6, the ring 26 of the coupling means 22 is rigidly associated with one end 27 of the flexible cable 5 to apply an action opposing the resistant load 3 in such a way that the rotation of the shaft 7 about the first axis 8 causes the ring 26 to oscillate, thereby creating vibrations along the flexible cable 5.

Conveniently, the device is quick and easy to mount on the gym machine and it is not necessary to adapt or modify the machine in any way. Indeed, the holes for the screws 6*d* normally used to fasten the cable to the weight stack in conventional weighted machines can conveniently be used.

Advantageously, the device 1 is removable. In particular, the screws 6*d* can be quickly and easily undone to release the coupling means 22 from the flexible cable 5. More in detail, in the embodiment of FIGS. 1 to 4, the cable can then simply be unwound from the idler pulley 23, while in the embodiment of FIGS. 5 and 6, the pipe 30 integral with the end 27 of the cable 5 must be screwed off cylindrical extension 29 of the ring 26.

The invention thus achieves the above mentioned aims.

The gym machine device according to the invention is simple to construct and is distinguished by compact size and light weight. That is because the vibrations are not generated by an eccentric weight rotated by a electric motor but by simply rotating a shaft about an eccentric pin.

Furthermore, the device is perfectly integrated in the gym machine, unobtrusively occupying very little, normally unused space above the weight stack.

The device can be mounted quickly and easily without having to modify the machine in any way. In addition, once the device has been mounted, training can be performed in two operating modes, with or without vibrations, by simply turning the drive motor on or off.

The invention described above may be modified and adapted in many ways without thereby departing from the scope of the inventive concept. Moreover, all details of the invention may be substituted by technically equivalent elements.

What is claimed is:

1. A gym machine comprising: a frame (2), at least one resistant load (3) mounted on the frame (2) having at least one coupling surface (4); at least one flexible cable (5) associated with the resistant load (3) for performing a physical exercise; a device (1) for generating vibrations, the device (1) comprising at least one support (6) designed to be rigidly associated with the resistant load (3) at the coupling surface (4), at least one shaft (7) rotatably coupled to the support (6) on a first axis (8) at a first portion (9) and having a second portion (10) with a second, eccentric axis (11), power drive means (12) for rotationally driving the shaft (7) about the first axis (8), the shaft (7) being associated with the flexible cable (5) at the second portion (10) in such a way as to generate vibrations along the flexible cable (5).

2. The gym machine according to claim 1, wherein the support comprises a first bracket (13) to which the first portion (9) of the shaft (7) is rotatably coupled to rotate about the first axis (8).

3. The gym machine according to claim 2, wherein the first bracket (13) is U-shaped and has at least two coaxial annular grooves (14) for receiving respective bearings for coupling to the shaft (7).

4. The gym machine according to claim 1, wherein the support (6) comprises a second bracket (15) for mounting the power drive means (12); said power drive means (12) comprising at least one motor (16) for driving at least one drive pulley (17) at least one predetermined rotation speed.

5. The gym machine according to claim 4, comprising at least one driven pulley (18) keyed to the shaft (7); the drive pulley (17) being connected to the driven pulley (18) by a belt (19) so as to transmit rotational drive to the shaft (7).

6. The gym machine according to claim 5, wherein the driven pulley (18) is keyed rigidly to the shaft (7) at a middle portion (20) by means of a key (21).

7. The gym machine according to claim 1, comprising coupling means (22) freely rotatably associated with the shaft (7), at the second portion (10), on the second eccentric axis (11); the coupling means (22) being designed to connect the shaft (7) to the flexible cable (5) in such a way that the rotation of the shaft (7) about the first axis (8) causes the coupling means (22) to oscillate, thereby creating vibrations along the flexible cable (5).

8. The gym machine according to claim 7, wherein the coupling means (22) comprise at least one idler pulley (23) freely rotatably associated with the shaft (7), at the second portion (10), on the second eccentric axis (11); the idler pulley (23) being designed to have the flexible cable (5) wound around it to apply an action opposing the resistant load (3) in such a way that the rotation of the shaft (7) about the first axis (8) causes the idler pulley (23) to oscillate, thereby creating vibrations along the flexible cable (5).

9. The gym machine according to claim 8, wherein the idler pulley (23) is coupled to the second portion (10) by an interposed first bearing (24).

10. The gym machine according to claim 9, wherein the second portion (10) has a threaded end part (25) for fastening the internal ring of the first bearing (24) to the shaft (7) with a bolt.

11. The gym machine according to claim 7, wherein the coupling means (22) comprise at least one ring (26) freely rotatably associated with the shaft (7), at the second portion (10), on the second eccentric axis (11); the ring (26) being rigidly associated with one end (27) of the flexible cable (5) to apply an action opposing the resistant load (3) in such a way that the rotation of the shaft (7) about the first axis (8) causes the ring (26) to oscillate, thereby creating vibrations along the flexible cable (5).

12. The gym machine according to claim 11, wherein the ring (26) has a radial seat (28) for rigidly housing the end (27) of the flexible cable (5).

13. The gym machine according to claim 11, wherein the ring (26) comprises a radial cylindrical threaded extension (29); the flexible cable (5) being integrally connected at its end (27) to an internally threaded pipe (30) designed to be screwed to the ring (26) at the cylindrical extension (29), in such a way as to fix the flexible cable (5) to the ring (26).

14. The gym machine according to claim 1, wherein the resistant load (3) is mounted on the frame (2) slidably on vertical guides (2*a*) and whose top surface (4*a*) comprises the coupling surface (4), wherein the support (6) is rigidly fixed to the resistant load (3) at the coupling surface (4) by screw means (6*a*).

15. The gym machine according to claim 14, comprising at least two cylindrical spacers (6*b*) having respective axial holes (6*c*) for the passage of respective screws (6*d*) designed to be screwed into corresponding threaded holes (6*e*) made in the resistant load (3) in order to fasten the support (6).

16. The gym machine according to claim 1, wherein the device is removable.

* * * * *